US005595385A

United States Patent [19]

Jablonski

[11] Patent Number: 5,595,385

[45] Date of Patent: Jan. 21, 1997

[54] GOLF PUTTER

[76] Inventor: Thaddeus M. Jablonski, 243 Richards Dr., Palatine, Ill. 60067

[21] Appl. No.: 512,565

[22] Filed: Aug. 8, 1995

[51] Int. Cl.[6] ..... A63B 53/14; A63B 53/16

[52] U.S. Cl. ..... 473/295; 473/204; 473/251; 473/314; 473/340

[58] Field of Search ..... 273/81.3, 193 B, 273/77 R, 80 C, 168, 80.1, 81.2, 81 C

[56] References Cited

U.S. PATENT DOCUMENTS

| | | | |
|---|---|---|---|
| 1,561,349 | 11/1925 | Murphy et al. | 273/81.3 |
| 2,321,773 | 6/1943 | Ruemelin | 273/81.3 X |
| 2,445,718 | 7/1948 | Sternberg et al. | 273/81.3 |
| 3,533,630 | 10/1970 | Monaco | 273/81.3 X |
| 3,663,019 | 5/1972 | Palotsee | 273/81.3 |
| 4,133,535 | 1/1979 | Marsh | 273/192 |
| 4,163,554 | 8/1979 | Bernhardt | 273/80 C |
| 4,866,979 | 9/1989 | Bernhardt | 73/65 |
| 5,088,738 | 2/1992 | Mundt | 273/193 B |

*Primary Examiner*—George J. Marlo
*Attorney, Agent, or Firm*—Juettner Pyle Lloyd & Piontek

[57] ABSTRACT

A golf putter comprising:

a putter head having a longitudinal dimension between a rear and a front of said putter head and a ball striking club face extending along said longitudinal dimension;

a putter shaft including a lower shaft section coupled at its lower end to said putter head and extending upwardly therefrom and an upper shaft section attached by coupling means to an upper end of said lower shaft section and extending only forwardly from said coupling means generally in a direction along said putter head longitudinal dimension from said rear to said front of said putter head; and a handle extending around and secured against rotation on said upper shaft section, said handle being supportable and rotatable on one hand of a golfer to accommodate pendulum-like movement of said putter head.

16 Claims, 2 Drawing Sheets

GOLF PUTTER

BACKGROUND OF THE INVENTION

The invention relates to a golf putter and more particularly to an improved shaft configuration for a golf putter that permits a golfer to obtain improved control over putting of a golf ball during a game of golf.

The game of golf requires a golfer to have the ability to perform with different golf clubs over a wide range of circumstances. A major part of golf is putting, which requires the highest degree of precision. This precision is accomplished by practice and, if one desires to become quite good at putting, a considerable amount of practice time is required to develop a correct putting stroke. The an of putting requires substantially different skills than are necessary when using other clubs, and there are a large number of different putting strokes, each of which differs from the others. However, these putting strokes all have in common the need to precisely repeat the putting stroke each and every time if a high degree of skill in putting is to be acquired. The putting stroke, to be truly effective, requires that the player acquire a form and discipline that is both unique and unnatural, as compared with that required when using other clubs. Form, technique, grip and execution are all critical functions of putting, and difficulty arises in precisely repeating them from one putting stroke to the next.

OBJECTS OF THE INVENTION

An object of the invention is to provide an improved golf putter that enables the act of putting to be reduced to a more basic and repeatable form.

Another object is to provide such a golf putter that allows for a more natural and comfortable grip on the putter.

A further object is to provide such a golf putter with which the effective swing of the putter is reduced to a more compact and simple motion that is easily acquired and repeatable by a user of the putter.

Yet another object is to provide such a golf putter that enables a user to have increased control over the relationship between the club face on the putter head and the golf ball.

SUMMARY OF THE INVENTION

In accordance with the present invention, a golf putter comprises a putter head having a longitudinal dimension between a rear and a front of the putter head and a ball striking club face extending along the longitudinal dimension. The golf putter also has a putter shaft including a first shaft section connected at a lower end to the putter head and extending upwardly from the putter head to a second shaft section that extends forwardly from the first shaft section and generally in the direction of the putter head longitudinal dimension from the rear to the front of the putter head.

Advantageously, the golf putter also includes a handle extending around, along and secured against rotation on the second shaft section, the handle being supportable and rotatable on a hand of a golfer to accommodate pendulum-like movement of the putter head. Also included is a grip extending around and along the first shaft section toward an upper end thereof, the grip being adapted to be grasped by the golfer's other hand for imparting the pendulum-like movement to the putter head.

Preferably, the putter head club face is planar and the second shaft section lies in a common plane with and extends in parallel relation to the putter head.

The foregoing and other objects, advantages and features of the invention will become apparent upon a consideration of the following detailed description, when taken in conjunction with the accompanying drawings.

DETAILED DESCRIPTION

Figure 1:
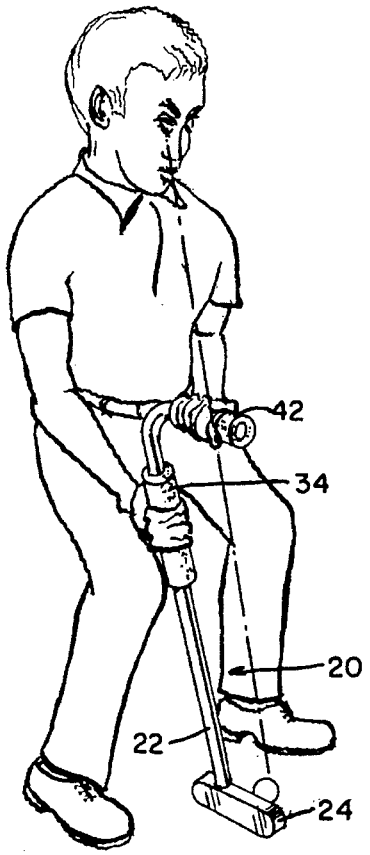
FIG. 1 is a diagrammatic representation of a golfer using a putter constructed according to the teachings of the invention.
Figure 3:
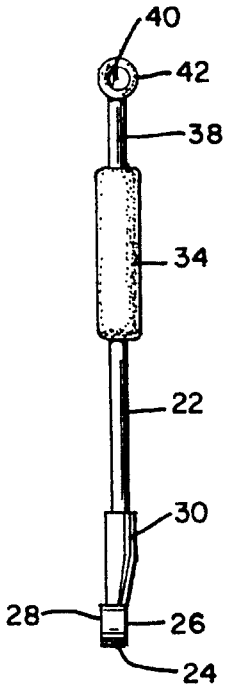
FIG. 3 is a front elevation view of the golf putter of FIG. 2.
Figure 2:
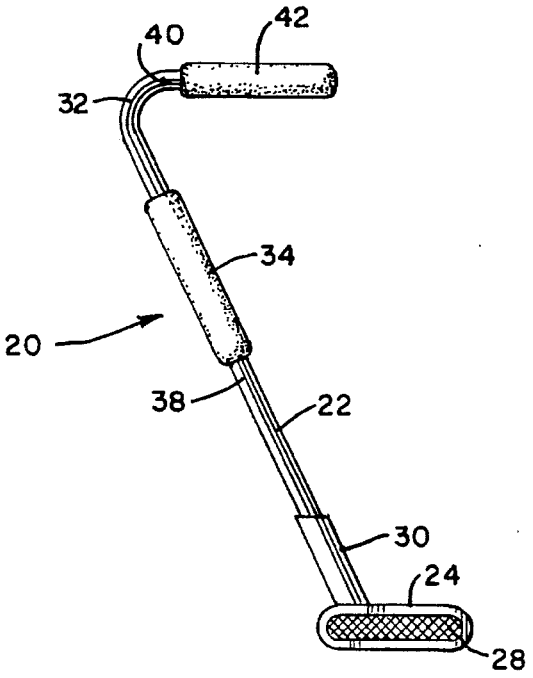
FIG. 2 is a side elevation view of a golf putter configured according to one embodiment of the invention.

Referring to FIGS. 1–3, a golf putter configured according to one embodiment of the invention is indicated generally at 20. The golf putter includes a putter shaft 22 that carries at its lower end a putter head 24 that is elongate and has a longitudinal dimension between a rear and a front of the putter head, which is from the left to right in FIG. 2. The putter head has a planar ball striking face or club face 26 on one side, or a planar club face 28 on an opposite side, depending upon whether the golf putter is for use by a right-handed or a left-handed golfer. Alternatively, the putter head may be provided with both the club face 26 and the club face 28, so that the golf putter may be used by either a right-handed or a left-handed golfer. When the golf putter is in a vertical operative position, the club faces 26 and 28 lie in vertical planes and the putter head extends longitudinally forward from the lower end of the putter shaft 22. An obtuse included angle is defined between the generally horizontal longitudinal dimension of the putter head and a lower longitudinal section 38 of the putter shaft.

The putter head 24 includes a tubular shank 30 within which the lower end of the lower section 38 of the putter shaft 22 is received and fastened to attach the putter head to the shaft. Between the putter head and an intermediate curved section 32 of the shaft, the lower shaft section 38 advantageously may be straight and extend along a longitudinal axis that is generally coaxial with the axis of the putter head shank 30, although the shaft section 38 could, if desired, not be straight and not extend along the entirety of its length coaxial with the axis of the putter head shank. A grip 34 is around and partially along the putter shaft lower section 38 toward an upper end thereof but below the intermediate shaft section 32. The grip may be constructed of leather or rubber in a conventional manner to provide a gripping surface to be grasped by a hand of a golfer. The grip would be held by the right hand of a right-handed golfer or by the left hand of a left-handed golfer.

The intermediate curved putter shaft section 32 extends between the upper end of the lower shaft section 38 and a rearward end of a longitudinally extending upper shaft section 40. When the golf putter 20 is held in a vertical operative position, and for a putter where the shaft section 38 is straight, all of the putter head 24 and the sections 32, 38 and 40 of the putter shaft 22 advantageously lie in a common plane and the upper shaft section 40 extends forwardly and, usually, horizontally. Alternatively, if the putter shaft section 38 is other than straight, then the sections 32 and 38 may or may not lie in a common plane with the upper shaft section 40 and the putter head 24,, but it is nevertheless desirable that, in any event, the upper putter shaft section 40 extend generally horizontally and lie in a common plane with the putter head. The arcuate extent of the curved intermediate shaft section 32 is such that an acute included angle is defined between the lower and upper longitudinally extending shaft sections 38 and 40 and such that the upper shaft section 40 extends generally parallel to the longitudinal dimension of the putter head 24. A handle 42 is nonrotationally fastened to and extends around and along the upper shaft section 40, and has a smooth outer surface of a low friction material such as plastic or wood. The grip 34 may be of a larger diameter than the handle 40 and is firmly grasped by one hand of the golfer while the handle 42 is supported and maintained free for rotation on the golfer's other hand to support the putter head 24 for pendulum-like swinging movement.

In use of the golf putter 20 by, a right-handed golfer, the grip 34 is grasped by the right hand of the golfer and the handle 42 is supported on the left hand of the golfer for free floating rotational movement of the putter on and with respect to the golfer's left hand. If the putter is to be used by a left-handed golfer, the grip 34 would be grasped by the left hand of the golfer and the handle 42 would be supported by the right hand.

For a right-handed golfer to putt a golf ball, the handle 42 is supported by the left hand and the grip 34 is grasped by the right hand of the golfer. While holding his left hand steady to support the handle 42 for rotational movement on his left hand, the golfer uses his right hand to first move the grip and thereby the putter head 24 away from the golf ball, and to then move the grip and putter head toward and to impact the golf bail with the club face of the putter head to effect a putting stroke. Because the putter handle 42 is supported on the golfer's left hand for rotation about a stationary axis, a pendulum-like movement is imparted to the putter head and may be precisely repeated with each putting stroke for improved and consistent putting of the golf ball.

The configuration of the golf putter 20 is such that the handle 42 extends generally parallel to the longitudinal dimension of the putter head 24 and to the club face 26 or 28, which advantageously enables the golfer to effectively maintain the club head at a desired attitude with respect to the golf bail. The handle 42 also advantageously and effectively serves as a rotatable bearing in the hand of the golfer, that controls and defines the swing and arc of the putter head. As such, the putting stroke is effectively reduced to that of a simple pendulum-like swing. Body motion is minimized and the most effective stroke thus becomes the most stable and repeatable.

Figure 4:
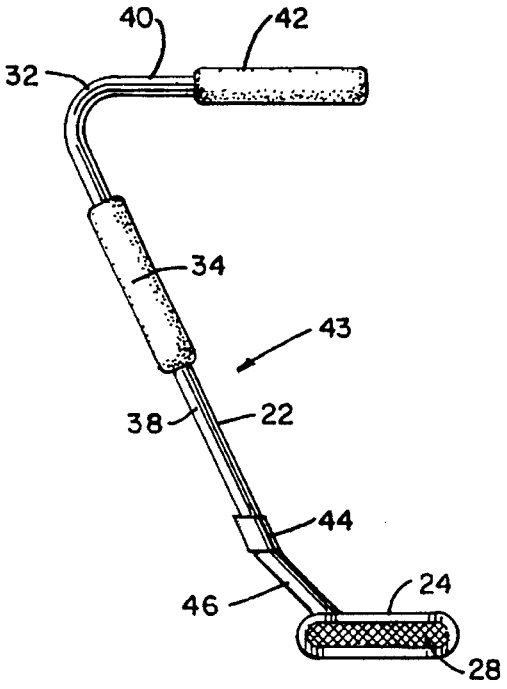
FIG. 4 is a side elevation view of a golf putter configured according to a second embodiment of the invention.

FIG. 4 shows an alternate embodiment of a golf putter 43 embodying the teachings of the present invention, in which like reference numerals have been used to denote like structure. The difference between the golf putter of FIG. 4 and the one of FIG. 2 resides in the shank for connecting the putter head 24 to the bottom of the lower putter shaft section 38. In FIG. 4 the shank comprises two pans, one of which is a tubular part 44 within which the lower end of the putter shaft is received and fastened, and the other of which is an extension 46 between the tubular pan and the putter head 24. The axes of the tubular part and of the extension are not coaxial, but instead an included obtuse angle is defined between them. Otherwise, the structure of the putter of FIG. 4 is generally the same as that of FIG. 2, and a similar description applies to the putter of FIG. 4.

Figure 5:
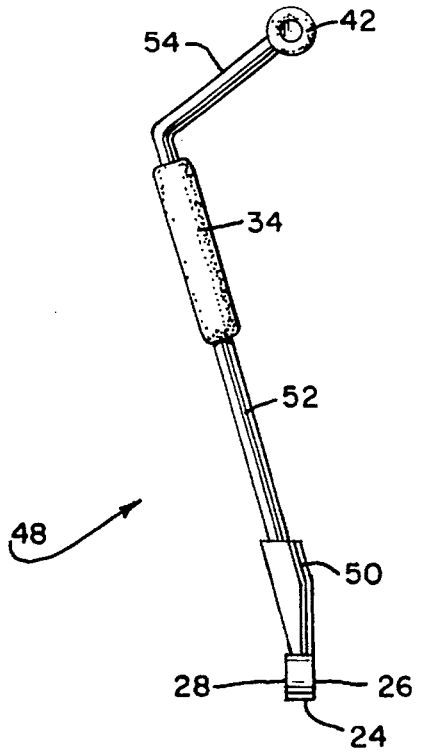
FIG. 5 is a front elevation view of a putter configured according to a third embodiment of the invention.

FIG. 5 shows a further embodiment of a putter 48 embodying the teachings of the invention, in which like reference numerals have again been used to denote like structure. As compared with the putter of FIGS. 2 and 3, in the one of FIG. 5 the putter head 26 and the handle 42 lie in a common plane, but none of a putter head shank 50, a lower putter shaft section 52 and an intermediate putter shaft section 54 lie in the plane. Instead, the shank 50 and lower shaft section 52 are coaxial and extend to the side of the plane, and the intermediate shaft section 54, which extends between the upper end of the lower shaft section and the upper shaft section supporting the handle 42, also extends to the side of the plane.

Figure 6:
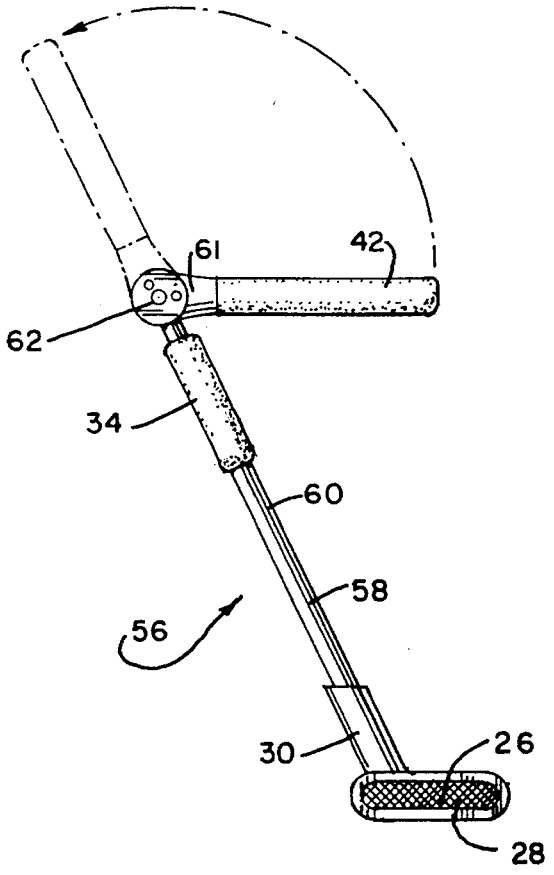
FIG. 6 is a side elevation view of a putter according to a fourth embodiment of the invention.

The embodiment of putter 56 shown in FIG. 6 is uniquely structured to facilitate its placement in a golf bag. As is known, golf bags are adapted to accept golf clubs having straight shafts, and to that end a shaft 58 of the putter has a lower shaft section 60 including the grip 34, an upper shaft section 61 including the handle 42, and an intermediate shaft section comprising latching means 62. The latching means may include any suitable means for accommodating rotation of the upper shaft section about the upper end of the lower shaft section and for fixing the upper shaft section in a selected rotational alignment with respect to the lower shaft section. In the contemplated embodiment, the fastening means is adapted to fasten the upper shaft section in a position extending forwardly from the lower shaft section, as shown in solid lines in FIG. 6, for normal use of the putter in accordance with the teachings of the invention. The fastening means also is adapted to fasten the upper shaft section in coaxial alignment with the lower shaft section, as shown in phantom lines, so that the putter 56 may then be placed in a golf bag.

While embodiments of the invention have been described in detail, various modifications and other embodiments thereof may be devised by one skilled in the art without departing from the spirit and scope of the invention, as defined in the appended claims.

What is claimed is:

1. A golf putter, comprising:

a putter head having a longitudinal dimension between a rear and a front of said putter head and a ball striking club face extending along said longitudinal dimension;

a putter shaft including a first shaft section connected at a lower end to said putter head and extending upwardly from said putter head at an obtuse angle with respect to said putter head longitudinal dimension to a second shaft section that extends between said first shaft section and a third shaft section which extends only forwardly from said second shaft section at an acute angle with respect to said first shaft section and generally in a direction along said putter head longitudinal dimension from said rear to said front of said putter head, and a handle extending around, along and secured against rotation on said third shaft section, said handle being supportable and rotatable on one hand of a golfer to accommodate pendulum-like movement of said putter head.

2. A golf putter as in claim 1, including a grip extending around and along said first shaft section, said grip for being grasped by the golfer's other hand for imparting the pendulum-like movement to said putter head.

3. A golf putter as in claim 1, wherein said putter head club face is planar and said first shaft section extends upwardly from said putter head in parallel relation to a plane of said club face.

4. A golf putter as in claim 1, wherein said putter head club face is planar and said third shaft section extends in parallel relation to a plane of said club face.

5. A golf putter as in claim 1, wherein said third shaft section extends forwardly from said second shaft section in generally parallel relation to said putter head longitudinal dimension.

6. A golf putter as in claim 1, wherein said putter head club face is planar and all of said first, second and third shaft sections lie in a common plane and extend in parallel relation to a plane of said club face.

7. A golf putter as in claim 1, wherein said first shaft section lower end is connected to said putter head toward said rear of said putter head.

8. A golf putter as in claim 1, wherein said putter head includes an upwardly extending shank and said first shaft section lower end is connected to said shank.

9. A golf putter comprising:

a putter head having a longitudinal dimension between a rear and a front of said putter head and a ball striking club face extending along said longitudinal dimension;

a putter shaft including a lower shaft section coupled at its lower end to said putter head and extending upwardly therefrom and an upper shaft section attached by coupling means to an upper end of said lower shaft section and extending only forwardly from said coupling means generally in a direction along said putter head longitudinal dimension from said rear to said front of said putter head, and a handle extending around, along and secured against rotation on said upper shaft section, said handle being supportable and rotatable on one hand of a golfer to accommodate pendulum-like movement of said putter head.

10. A golf putter as in claim 9, including a grip extending around and along said lower shaft section, said grip for being grasped by said golfer's other hand for imparting the pendulum-like movement to said putter head.

11. A golf putter as in claim 10, wherein said upper shaft section extends forwardly in generally parallel relation to said putter head longitudinal dimension.

12. A golf putter as in claim 10, wherein said putter shaft coupling means includes an intermediate shaft section coupling an upper end of said lower shaft section to a rearward end of said upper shaft section.

13. A golf putter as in claim 12, wherein all of said putter head and said lower, intermediate and upper shaft sections lie in a common place.

14. A golf putter as in claim 12, wherein said putter head and said putter shaft upper section lie in a common plane and said putter shaft lower and intermediate sections are outside of said plane.

15. A golf putter as in claim 10, wherein said putter shaft coupling means comprises latch means for coupling said upper putter shaft section to said lower putter shaft section in adjustable and selected orientations.

16. A golf putter as in claim 15, wherein said latch means couples said lower and upper shaft sections for relative rotational movement and accommodates rotational orientation of said upper shaft section between positions where said upper shaft section extends generally along the longitudinal dimension of said putter head for use of said golf putter in putting a golf ball and where said upper shaft section extends generally coaxial with said lower shaft section to accommodate placement of said golf putter in a golf bag.

* * * * *